US010660371B2

(12) United States Patent
Ngo et al.

(10) Patent No.: US 10,660,371 B2
(45) Date of Patent: May 26, 2020

(54) ELECTRONIC VAPING SYSTEMS

(71) Applicant: Zuna Inc., San Jose, CA (US)

(72) Inventors: Phuc Ngo, San Jose, CA (US); Kris Le, San Jose, CA (US); Vidyadhar Handragal, San Jose, CA (US)

(73) Assignee: Zuna, Inc., San Jose, CA (US)

( * ) Notice: Subject to any disclaimer, the term of this patent is extended or adjusted under 35 U.S.C. 154(b) by 64 days.

(21) Appl. No.: 15/973,485

(22) Filed: May 7, 2018

(65) Prior Publication Data

US 2019/0335808 A1 Nov. 7, 2019

(51) Int. Cl.
*A24F 47/00* (2020.01)
*B65D 81/32* (2006.01)

(52) U.S. Cl.
CPC ..... *A24F 47/008* (2013.01); *B65D 81/3205* (2013.01)

(58) Field of Classification Search
CPC ..... A24F 47/008
See application file for complete search history.

(56) References Cited

U.S. PATENT DOCUMENTS 5,242,111 A * 9/1993 Nakoneczny ..... A61L 9/127 239/44
2006/0093765 A1 5/2006 Mueller
2015/0181945 A1 7/2015 Tremblay

* cited by examiner

*Primary Examiner* — Michael H. Wilson
*Assistant Examiner* — Jennifer A Kessie

(57) ABSTRACT

A vape wick package includes a wick; a first frangible shell containing the wick; a second frangible shell containing an electronic juice (e-juice), wherein the wick and e-juice shells are in a dual chamber frangible shell; and a protective layer covering first and second frangible shells.

20 Claims, 5 Drawing Sheets

| |
|---|
| Selecting a material for use as the wick and inserting the wick in a first shell |
| Depositing an electronic juice (e-juice) in a second shell |
| Placing the wick and e-juice shells in a dual chamber frangible layered shell |
| Protecting the dual chamber frangible layered shell with a protective layer |
| Opening a package that contains individual wicks for insertion onto the coil of the vaping device |
| Inserting the wick onto a coil and upon insertion onto the coil, shearing the frangible shell and leaving behind only the wick on the coil |
| During insertion, rupturing the second shell containing the e-juice and saturating the wick |

FIG. 5

ELECTRONIC VAPING SYSTEMS

BACKGROUND

The invention relates to electronic vaping devices usable by users to "vape", i.e., draw (e.g., inhale, puff, etc.) vapor from the electronic vaping devices using their mouth.

Electronic vaping devices, which are sometimes referred to as "electronic cigarettes", "e-cigarettes" or "personal vaporizers", are becoming increasingly popular. For instance, electronic cigarettes may be used by various people to simulate smoking (e.g., tobacco smoking), including current or past smokers of tobacco cigarettes (e.g., who are trying to quit or may have previously quit tobacco smoking) and individuals who never were smokers of tobacco cigarettes.

The world of electronic vaping, provides a massive selection of different styles and types of devices that can be easily classified as overwhelming. Various types of vapor devices are available ranging from e-cigarettes to high wattage advanced personal vaporizers.

FIG. 1A shows a basic diagram of a Vape Device. There are a few basic parts that all vaping devices have in common. They appear different in appearance and form factors, from one another, but perform the same basic functions. The typical parts associated with a Vaping Device is explained below:

a) Vape Tanks or atomizers: This part of the device houses the wicks, e-liquid and heating coil. Atomizer has one or more resistance wire coils and its wick(s) often with some form of reservoir to hold e-liquid. They are available in different styles that include atomized cartridges, Cartomizers, Clearomizers, Rebuildable Tank Atomizers, Rebuildable Dripping Atomizers, Hybrid Atomizers (rebuildable dripping tank atomizers and Genesis Atomizers).

b) Vape Coils: a replaceable assembly or section of wire that has been wound into a spring like coil shape. The coils are then wicked with an absorbent material, like cotton, which absorbs the e-liquid. The wire coils(s) are then heated to vaporize the e-liquid on the wicks. The Coil's resistance depends upon several factors including the type of wire used, the diameter of the coil and the number of wraps a coil has. Resistance is the key unit of a coil that determines the amount of electricity it will need to power it and the amount of heat it will produce.

c) Batteries: powers the device or Mod, some devices use an integrated battery while the others use replaceable cells.

d) Vape Mods: The device housing batteries that connects and transfers power to the clearomizer or atomizer.

e) E-Juice/Concentrates: A mixture of propylene glycol, vegetable glycerin, food flavorings, and sometimes nicotine which is heated to create vapor for inhalation.

Most electronic vaping device, are subjected to replacement or replenishment of 3 components that will permit to continue vaping: 1) The e-liquid 2) the coils used in the clearomizer and 3) the wicks.

FIG. 1B shows in more details the wick used in the vape device of FIG. 1A. Wicks play an important role in how well the vaporizer performs. Wicks are the components that carry e-liquids to the coil. Application of the wick onto/into the coil is more a "technique" with various hand tools (cutters, tweezers, etc.) involved. Often, it takes considerable amount of trial and error to "nail wick" with an atomizer. It takes effort & time before a vaper really learns the art of "priming the wick".

The deployment of the wick in the vape device is complex with 3 steps:

Step 1: insert the wicking material (organic cotton. In this representation) These usually come in sheets or rolls and need to be cut to~a half inch strip before removing the first thin layers (on one or both sides) which are a bit more rigid than the stuff on the inside. Then the cotton is rolled and one of the ends is made to pass through the coil. When the cotton passes the coil, it needs to have a bit of resistance but at the same time it doesn't have to be so compact that it pulls the coil with it.

Step 2: Typical practice is to cut the ends of the cotton and leave around half an inch sticking out of each side of the resistance. Later, the cotton is tugged in the e-juice well just under the coils and using some e-liquid to saturate the wicking material. This process is repeated depending on the number of coils.

Step 3: Saturated wick ready to be inserted & vaped.

The "dry hits" are the worst experience a user can have during a normal vaping session. A dry hit is the moment when the user pulls on an atomizer or cartomizer that's not fully saturated. This lack of saturation causes the heat to warm up the actual wicking material, burning or charring it slightly and bringing an extremely unpleasant flavor into the mouth. No matter how experience the user is as a vaper or how careful the user inserts the wick, a dry hit can always creep up when least expected. In addition to various reasons that lead to an "dry hit", the art of priming the wick plays an important role in ensuring a good vaping experience. The below list tries to summarize the adverse effects of improper wicking as can be heard or learnt from various vaping experiences:

a) If the wick is loose and is not making good contact with a coil, those spots will eventually get 'cooked' by the heat of the coil and will scorch and cause a burnt taste.

b) The taste of the vapor will be the biggest indicator for any vaper. It is common knowledge that if it doesn't taste right then it needs rewicking. Too tight or too loose cotton (or other wicking material) can potentially alter the taste. Too tight of a wicking can provide a more intense cotton taste and will feel dryer and less flavorful than it should be.

c) Depending on which cotton or wicking material used for the wicks, there are sometimes stray strands that pop up, if any stray strands are either coming out from the cotton inside the coil or at the edge of the coil. Normal practice is to try to remove them (with tweezers). If they are not removed then they can affect the taste (as they will burn) when you start vaping, they make it scratchier on the throat and have a 'burnt hair' taste.

SUMMARY

In one aspect, a vape wick package includes a wick; a first frangible shell containing the wick; a second frangible shell containing an electronic juice (e-juice), wherein the wick and e-juice shells are in a dual chamber frangible shell; and a protective layer covering first and second frangible shells.

In another aspect, a vape device includes a vape tank including a heating coil, wherein the vape tank receives a package with a wick; a first frangible shell containing the wick; a second frangible shell containing an electronic juice (e-juice), wherein the wick and e-juice shells are in a dual chamber frangible shell; and a protective layer covering first and second frangible shells; and one or more vape coils to emit vapor for user inhalation.

In a further aspect, method for packaging a wick includes:

selecting a material for use as the wick and inserting the wick in a first shell;

depositing an electronic juice (e-juice) in a second shell;

placing the wick and e-juice shells in a dual chamber frangible layered shell; and protecting the dual chamber frangible layered shell with a protective layer.

Advantages of the system may include one or more of the following. The system addresses the problems associated with the typical manual wicking performed onto a heating coil. The desired wicks in provided in a "preformed shape" that can be readily inserted onto the coils & commence the vaping after the vaping device is setup. The system provides a seamless experience for the user during the wick replacement. The user installation of the wick is done in an efficient manner to enable the user to derive the maximum benefits of vaping without the hassles from an incorrect assembly of the wick contributing to the adverse effects as described above. The preformed shapes can be designed to be accommodated onto various vaping devices types. Various wicking materials can be accommodated within the frangible shell. Various types of e-juice can be prefilled to suit individual tastes. The wicking material stays wet always and opportunity to predefine a liquid viscosity that the heating coil can handle. The messy procedure of shaping & inserting a wick is completely reduced to just a single step insertion onto the coils & the vaping device is ready to use.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 5 illustrates an exemplary process for making and using vape wicks.

DESCRIPTION

The invention now will be described more fully hereinafter with reference to the accompanying drawings, in which some, but not all embodiments of the invention is shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A dual chambered frangible wick is disclosed for a seamless wick replacement is described next. As a first step, the most desired wick characteristics have to be performed on the selected wick material. Next, the wick material is packaged using a frangible process. Finally, the packaged wick with the e-juice is deployed in the vape device.

Figure 1A:
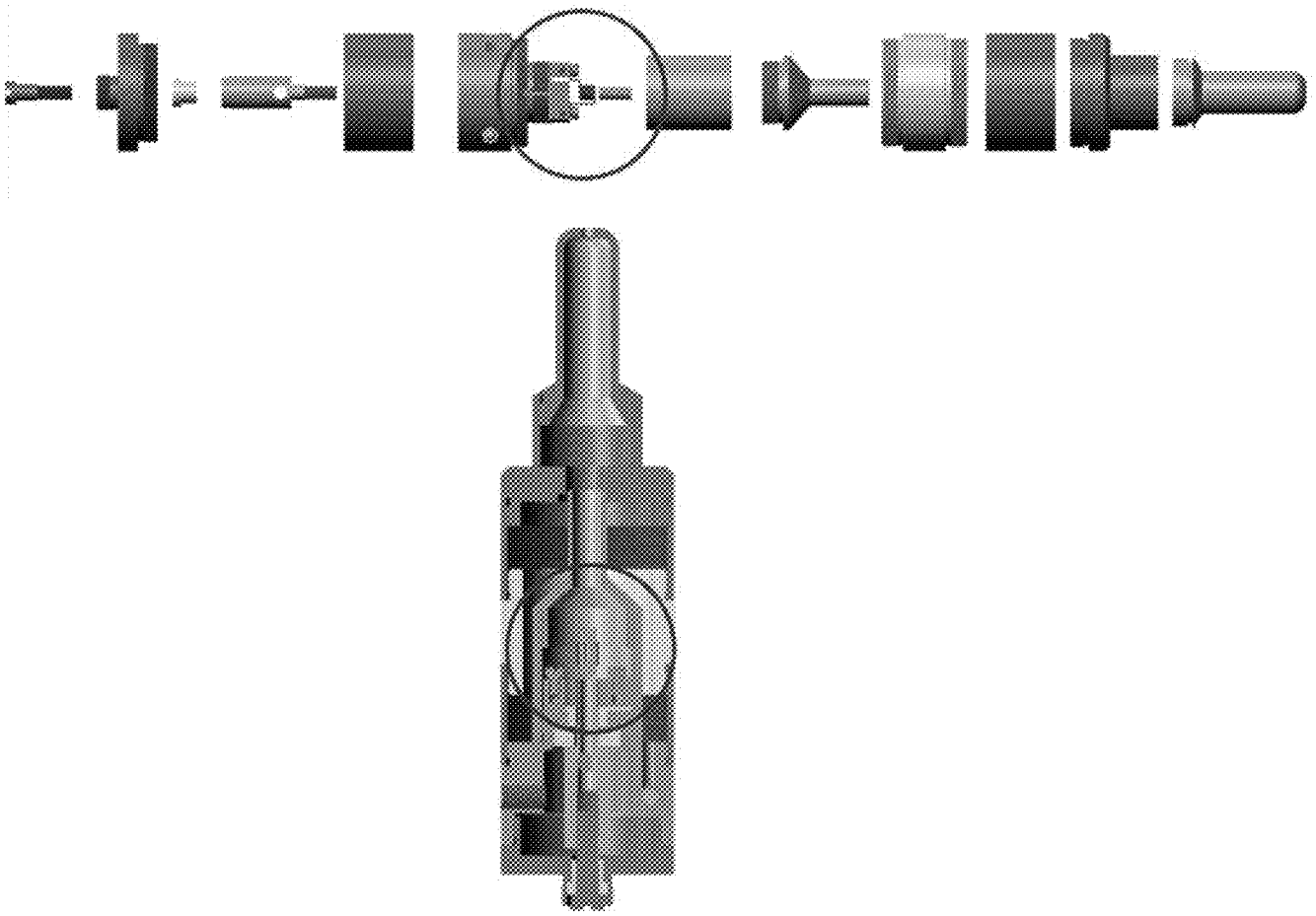
FIGS. 1A and 1B illustrate an exemplary vape device including a wick chamber.
Figure 1B:
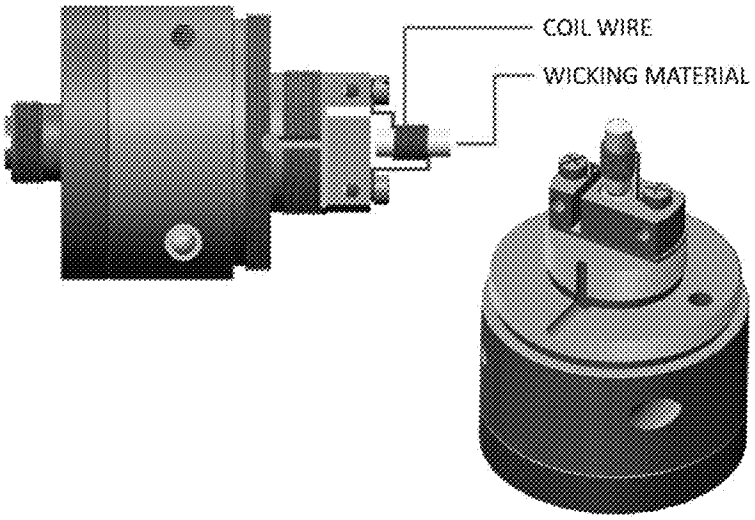
Figure 2:
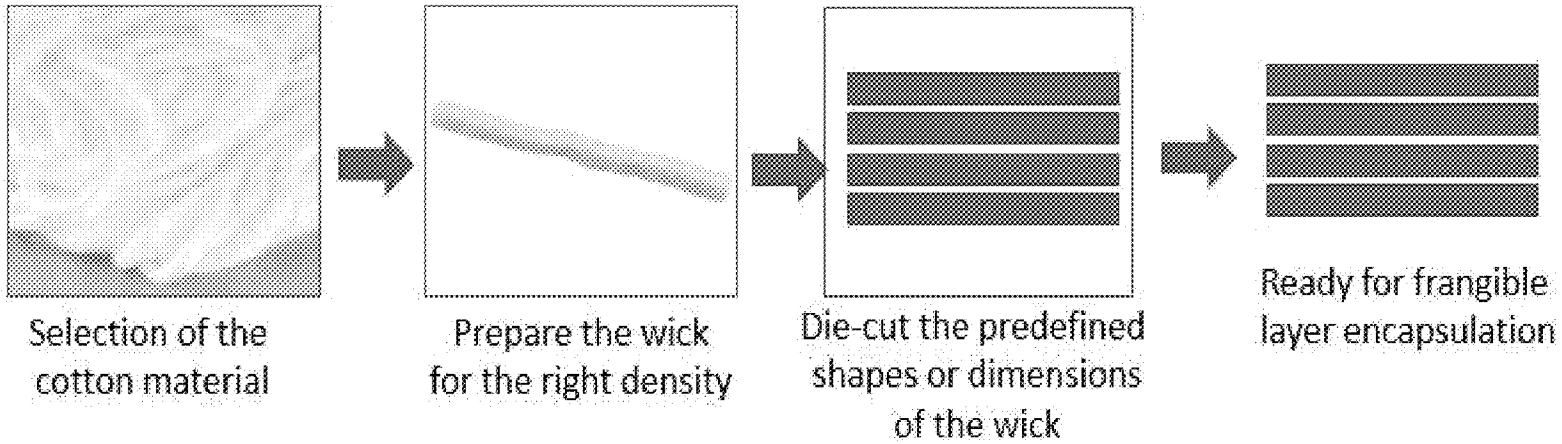
FIG. 2 shows an exemplary process for preparing a wick material prior to encapsulation in a pouch having a frangible seal.

FIG. 2 shows an exemplary process for preparing a wick material prior to encapsulation in a pouch having a frangible seal. In the construction of the wick, the wick material is selected. The below factors are considered to predefine the wick that will be further encapsulated in a frangible shell.

a. Selection of the right wick material b. Ensuring the right predetermined density of the wick material c. Ensuring the right length, width, height of the wick material (can vary depend on the coil types we intend to cater)

For example, the material can be cotton. Various types of cotton can be used. For example, sterile cotton balls can be used. These balls are cheap, easy to find, and have good flavor. However, they are easily burnt, have slow wicking. Other materials that can be used include Cellulose Cotton (CelluCotton), Japanese Organic Cotton, Cotton Bacon, Cellulose Rayon (Rayon), Hemp, or silica fiber wicks.

All of the above is done for the purpose of "wick tuning" to ensure the right material selection, thickness control, surface patterning, substrate support patterning, among others.

Next, the wick is prepared for the right density. The wick material is die-cut to predefined dimensions or shapes for the wick prior to the frangible layer encapsulation detailed in FIG. 3.

Figure 3A:
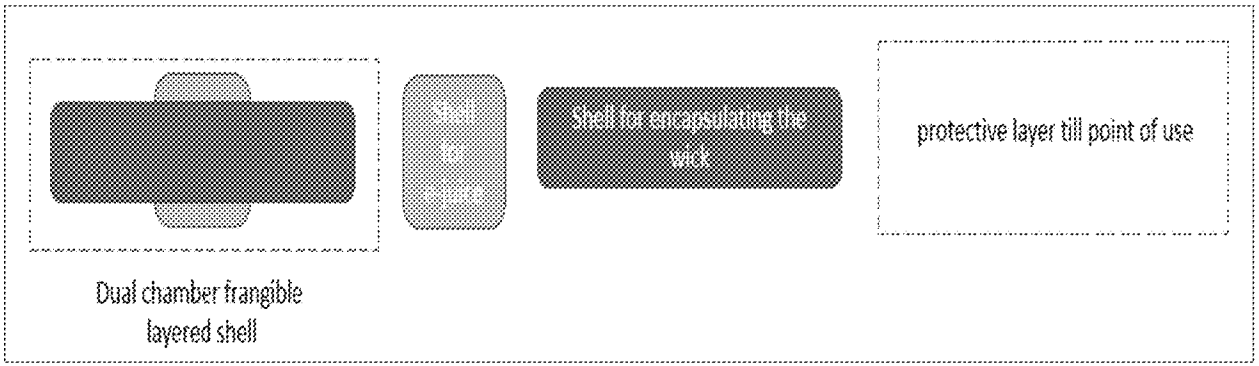
FIG. 3A is a perspective view of a dual-compartment pouch having a frangible seal.

FIG. 3A is a perspective view of a dual-compartment pouch having a frangible seal. The construction of the frangible shell is detailed next. The frangible shell is a pressure-rupturable membrane diaphragm that may be tuned to rupture at a desired rupture threshold, rupture site, with a desired rupture pattern, and/or within a desired rupture time.

As shown in FIG. 3A, a first shell contains the preformed wick prepared using the process of FIG. 2. A second shell is used to contain the e-juice. A third shell provides secondary protection to the first two frangible shells and to sustain handling a accidental breakage until the point of use. The protective layer is a substantially non-frangible layer disposed over the frangible layer to prevent premature rupture of the frangible layer at an ambient environment pressure or normal handling till the point of use.

Figure 3B:
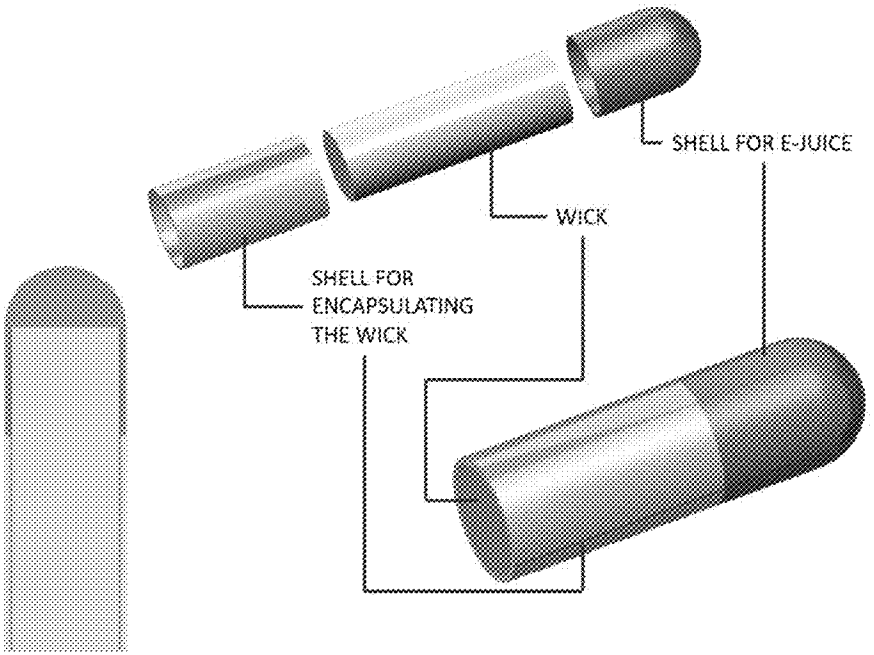
FIG. 3B shows one implementation of FIG. 3A.

FIG. 3B shows one implementation of FIG. 3A, where the wick is cylindrical in shape, with a shell encapsulating the wick, and a shell for e-juice mounted at one end of the assembled device, which resembles a rounded bullet in shape.

The physical characteristics of the frangible layer can be configured to control the rupture threshold and can be designed with assistance of a finite element analysis (FEA). The frangible layer will sustain the frictional wear induced while insertion onto the coils.

The pouch of the preferred embodiment may be prepared from a variety of suitable plastic materials whereby a strong, lightweight, reliable, yet economic container is provided. Preferably, each sheet comprises a plastic material having an inner surface capable of forming a strong heat seal with the inner surface of the opposite sheet to define the pouch. Suitable plastic materials include both multi- and monolayered films, webs, laminates, and the like.

In some embodiments, the pouch may comprise a suitable elastomeric material, such as olefin-based materials, including but not limited to, polyethylene, propylene ethylene copolymers, ethylene-vinyl acetate copolymers, ethylene-acrylic ester copolymers, iononomers, and combinations thereof. Additionally, film layers comprising polymers having barrier properties, such as polyvinylidene chloride and ethylene-vinyl alcohol copolymers, as well as film layers of such polymers as polyvinyl chloride, polyester, polyamide, and polyurethanes may also be used. The pouch may also comprise any flexible material, including, polypropylene film, polyethylene film, plasticized polyvinyl chloride film, plasticized polyvinylidene chloride film, polyethylene/ethylene-vinyl acetate copolymer laminate, ethylene-vinyl acetate copolymer/polyvinylidene chloride/ethylene-vinyl acetate copolymer laminate, and polyethylene/ethylene-vinyl acetate copolymer/polyethylene chloride/ethylene-vinyl acetate copolymer/polyethylene laminate, among others.

In other embodiment, the frangible seal separates the interior of the pouch into at least two compartments. The frangible seal comprises two strips of thermoplastic material that are disposed in the interior of the pouch. One of the strips of thermoplastic material is sealed to an interior surface of the front sheet and the other strip of thermoplastic material is sealed to an interior surface of the rear sheet. The strips are sealed to each other in a face-to face orientation to define two separate and distinct compartments in the pouch. The strips of thermoplastic material are adapted to form strong bonds with the front and rear sheets and to form a bond with each other that can be easily broken. As a result, the seal strength between the two strips of material can be controlled to produce a seal that can be broken with minimal effort without having to sacrifice the desirable heat sealing properties of the front and rear sheets. In some embodiments, the frangible seal may be produced by using strips of thermoplastic material that form stronger bonds with the front or rear sheet than they do with each other. In other embodiments, the frangible seal may be produced by simultaneously applying heat to the opposite exterior surfaces of the pouch so that the strips bond to the interior surfaces of the pouch and to each other at substantially the same time. In this embodiment, the amount of heat can be controlled so that the level of heat reaching the interface of the two strips is less than the amount of heat sealing the strips to the pouch. As a result, it is possible to selectively control the strength of the frangible seal so that it can be designed to break easily yet still provide a seal which will not be broken unintentionally. The dual-compartment pouch having a frangible seal can be adapted to have a desired level of strength without having to sacrifice the strength of the seal that joins the front and rear sheet together.

In some embodiments, the first and second thermoplastic materials comprise thermoplastic films selected from ethylene homopolymer, ethylene copolymer, propylene homopolymer, propylene homopolymer, propylene copolymers, and blends thereof. In one embodiment, the first and second materials comprise a blend ethylene copolymer and ethylene copolymer. Suitable ethylene copolymers include ethylene/alpha-olefin copolymers. The term "ethylene/alpha-olefin copolymer" generally designates copolymers of ethylene with one or more comonomers selected from C3 to C20 alpha-olefins, such as 1-butene, 1-pentene, 1-hexene, 1-octene, methyl pentene and the like, in which the polymer molecules comprise long chains with relatively few side chain branches. In one embodiment, the amount of propylene ethylene copolymer present in the blend may be in the range of about 60 to 95 percent by weight and the amount of ethylene/alpha-olefin copolymer may in the range of about 5 to 40 percent by weight.

In some embodiments, the first and second materials may also include elastomers. The term "elastomer" refers generally to a material that, at room temperature, can be stretched repeatedly to at least twice its original length. This characteristic distinguishes plastics from elastomers and rubbers, as well as the fact that elastomers are given their final properties by mastication with fillers, processing aids, antioxidants, curing agents, etc., followed by vulcanization (curing) at elevated temperatures. However, a few elastomers are thermoplastic. Such thermoplastic elastomers include the following preferred materials: styrene-ethylene-butylene-styrene copolymer (SEBS), styrene-butadiene-styrene copolymer (SBS), styrene-isoprene-styrene copolymer (SIS), ethylene-propylene rubber (EPM), and ethylene-propylene-diene terpolymer (EPDM).

Using separate materials to create the frangible seal rather than creating the frangible seal by direct attachment of the front and rear sheets together may provide many advantages. The separately attached strips help to control the resulting properties of the frangible seal without having to compromise film properties that are associated with the front and rear sheets, such as perimeter seal strength, optical properties, stiffness, and the like. As a result, a frangible seal can be produced that can be designed to withstand high sterilization temperatures, while still allowing the frangible seal to be easily broken without having to compromise the strength of the bond between the front and rear sheets. In addition, as discussed below, the resulting frangible seal properties can be controlled by material selection and the amount heat that is applied to produce the frangible seal.

Figure 4:
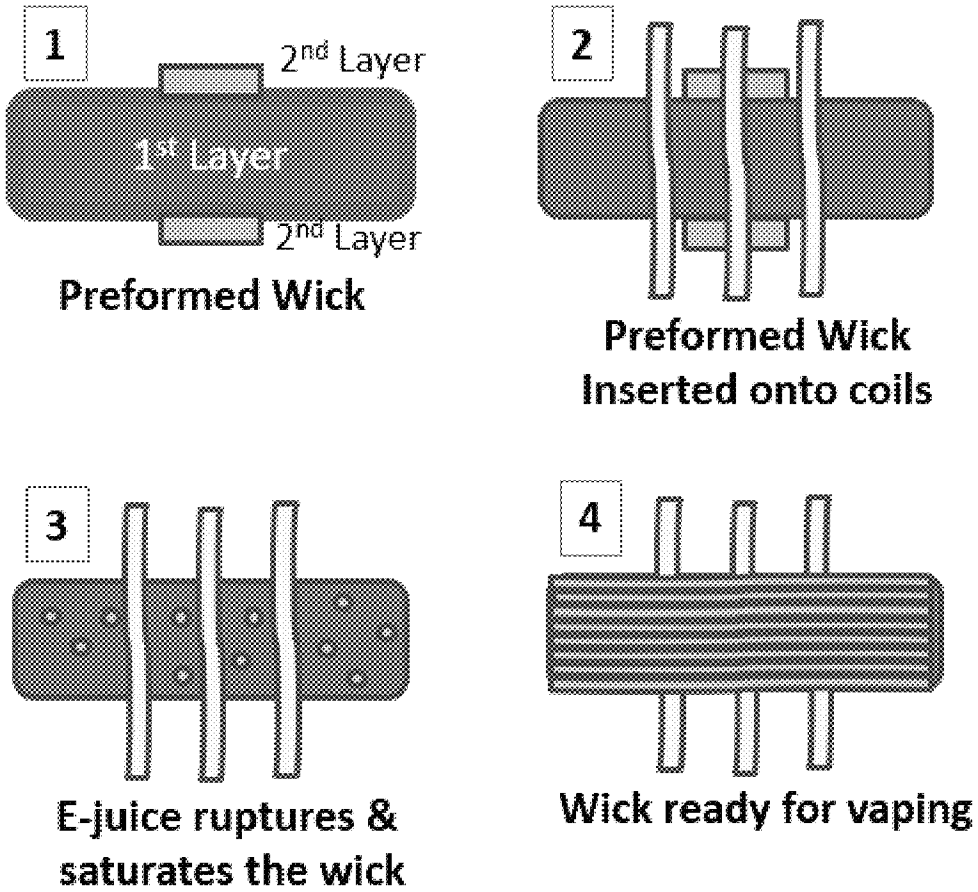
FIG. 4 illustrates the operation of the dual-chambered pouch with the frangible seal.

FIG. 4 illustrates the operation of the dual-chambered pouch with the frangible seal. The process is as follows:

1) User opens the package that contains individual wicks for insertion onto the coil of the vaping device.
2) Takes out the frangible shell & inserts onto the coil. Upon insertion onto the coil, the frangible shell shears off, leaving behind only the wick on the coil.
3) The second frangible shell containing the e-juice ruptures in the process of insertion thereby saturating the wick.
4) The vaping device is powered on & the vaping can commence.

FIG. 5 illustrates an exemplary process for making and using vape wicks. One embodiment is as follows:

Selecting a material for use as the wick and inserting the wick in a first shell Depositing an electronic juice (e-juice) in a second shell Placing the wick and e-juice shells in a dual chamber frangible layered shell Protecting the dual chamber frangible layered shell with a protective layer Opening a package that contains individual wicks for insertion onto the coil of the vaping device Inserting the wick onto a coil and upon insertion onto the coil, shearing the frangible shell and leaving behind only the wick on the coil During insertion, rupturing the second shell containing the e-juice and saturating the wick The system addresses the problems associated with the typical manual wicking performed onto a heating coil. The desired wicks in provided in a "preformed shape" that can be readily inserted onto the coils & commence the vaping after the vaping device is setup. The system provides a seamless experience for the user during the wick replacement. The user installation of the wick is done in an efficient manner to enable the user to derive the maximum benefits of vaping without the hassles from an incorrect assembly of the wick contributing to the adverse effects as described above. Other advantages may include the following:

1. Preformed shapes can be designed to be accommodated onto various vaping devices types
2. Various wicking materials can be accommodated within the frangible shell.
3. Various types of e-juice can be prefilled to suit individual tastes.
4. The wicking material stays wet always and opportunity to predefine a liquid viscosity that the heating coil can handle.

5. The messy procedure of shaping & inserting a wick is completely reduced to just a single step insertion onto the coils & the vaping device is ready to use.

Many modifications and other embodiments of the invention set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without one or more elements that are not specifically disclosed herein.

Although various embodiments and examples have been presented, this was for the purpose of describing, but not limiting, the invention. Various modifications and enhancements will become apparent to those of ordinary skill in the art and are within the scope of the invention.

What is claimed is:

1. A method for packaging a wick, comprising:

selecting a material for use as the wick and inserting the wick in a first shell;

depositing an electronic juice (e-juice) in a second shell;

placing the wick and e-juice shells in a dual chamber frangible layered shell; and protecting the dual chamber frangible layered shell with a protective layer.

2. The method of claim 1, comprising:

removing the protective layer prior to use; and inserting the wick into a vaping device.

3. The method of claim 1, comprising:

opening a package that contains individual wicks for insertion onto the coil of the vaping device;

inserting the wick onto a coil and upon insertion onto the coil, shearing the frangible shell and leaving behind only the wick on the coil; and during insertion, rupturing the second shell containing the e-juice and saturating the wick.

4. The method of claim 1, comprising powering on the vaping device and commencing vaping.

5. The method of claim 1, comprising selecting the wick material from cotton, hemp or silica.

6. The method of claim 1, comprising preparing the wick material for a predetermined density.

7. The method of claim 1, comprising cutting the wick material into a predetermined shape or dimensions.

8. The method of claim 1, comprising selected a preformed wick shape for accommodation with a predetermined vaping device.

9. The method of claim 1, comprising packaging cut wick material with a frangible encapsulation.

10. The method of claim 1, comprising accommodating one or more preselected wicking material within the frangible shell.

11. The method of claim 1, comprising filling the second frangible shell with preselected e-juice for individual user preference.

12. The method of claim 1, wherein the wicking material stays wet continuously.

13. The method of claim 1, comprising predefining a liquid viscosity output from the wick for handling by a heating coil.

14. The method of claim 1, comprising applying finite element analysis (FEA) to design the shells to rupture with a predetermined force.

15. A package, comprising:

a wick;

a first frangible shell containing the wick;

a second frangible shell containing an electronic juice (e-juice), wherein the wick and e-juice shells are in a dual chamber frangible shell; and a protective layer covering first and second frangible shells.

16. The package of claim 15, wherein during insertion, the second shell containing the e-juice is ruptured to saturate the wick.

17. The package of claim 15, wherein the shells are designed using finite element analysis (FEA) to rupture with a predetermined force.

18. A system, comprising:

a vape tank including a heating coil, wherein the vape tank receives a package with a wick;

a first frangible shell containing the wick;

a second frangible shell containing an electronic juice (e-juice), wherein the wick and e-juice shells are in a dual chamber frangible shell; and a protective layer covering first and second frangible shells; and one or more vape coils to emit vapor for user inhalation.

19. The system of claim 18, wherein during insertion, the second shell containing the e-juice is ruptured to saturate the wick.

20. The system of claim 18, wherein the shells are designed using finite element analysis (FEA) to rupture with a predetermined force.

* * * * *